US009061398B2

(12) United States Patent
Poole et al.

(10) Patent No.: US 9,061,398 B2
(45) Date of Patent: Jun. 23, 2015

(54) HAND TOOL WITH COMPOUND LEVERAGE MECHANISM

(76) Inventors: Robert N. Poole, Scottsdale, AZ (US); Daniel Poole, Glendale, AZ (US)

( * ) Notice: Subject to any disclaimer, the term of this patent is extended or adjusted under 35 U.S.C. 154(b) by 317 days.

(21) Appl. No.: 13/280,369

(22) Filed: Oct. 25, 2011

(65) Prior Publication Data

US 2012/0096994 A1 Apr. 26, 2012

Related U.S. Application Data

(60) Provisional application No. 61/406,939, filed on Oct. 26, 2010, provisional application No. 61/419,258, filed on Dec. 3, 2010.

(51) Int. Cl.
*B25B 7/12* (2006.01)

(52) U.S. Cl.
CPC ..... *B25B 7/12* (2013.01)

(58) Field of Classification Search
USPC ..... 81/342, 346–351, 381–383.5
See application file for complete search history.

(56) References Cited

U.S. PATENT DOCUMENTS

| | | | | | |
|---|---|---|---|---|---|
| 132,044 | A * | 10/1872 | Bacher | ..... | 30/189 |
| 1,497,969 | A * | 6/1924 | Arbogast | ..... | 81/383.5 |
| 1,850,664 | A * | 3/1932 | Daniels | ..... | 81/383.5 |
| 3,273,238 | A * | 9/1966 | Kuhbier | ..... | 81/383.5 |
| 6,532,847 | B2 * | 3/2003 | Liou | ..... | 81/381 |

* cited by examiner

*Primary Examiner* — Hadi Shakeri
(74) *Attorney, Agent, or Firm* — Parsons & Goltry; Robert A. Parsons.; Michael W. Goltry

(57) ABSTRACT

A compound leverage hand tool includes a first section having a first handle end and an opposing first jaw portion with a first jaw end, a second section having a second handle end and a link end, and a second jaw portion having a second jaw end and a lever end, the second jaw portion pivotally coupled to the first jaw portion at a first pivot point intermediate the second jaw end and the lever end. The link end is pivotally coupled to the lever end at a second pivot point, and the link end is pivotally coupled to the first section proximate the first jaw portion at a sliding pivot point intermediate the first pivot point and the second pivot point.

5 Claims, 11 Drawing Sheets

HAND TOOL WITH COMPOUND LEVERAGE MECHANISM

CROSS-REFERENCE TO RELATED APPLICATIONS

This application claims the benefit of U.S. Provisional Application No. 61/406,939, filed 26 Oct. 2010 and U.S. Provisional Application No. 61/419,258, filed 3 Dec. 2010.

FIELD OF THE INVENTION

This invention relates to hand tools.

More particularly, the present invention relates to hand tools having compound leverage mechanisms for increased power.

BACKGROUND OF THE INVENTION

In the field of hand tool, the force required to operate the tool can be of great importance. In particular, cutting tools often require the application of great force in order to cut the material desired. For many individuals, this can present a problem, and require the use of tools other than hand tools. In the past, this problem has been partially resolved by employing compound devices for multiplying the force applied through mechanical advantage.

It would be highly advantageous, therefore, to remedy the foregoing and other deficiencies inherent in the prior art.

An object of the present invention is to provide an adornment for a bottle.

Another object of the present invention is to provide a bottle adornment and attachment device that is robust.

Yet another object of the present invention is to provide a bottle adornment and attachment device that is effective.

SUMMARY OF THE INVENTION

Briefly, to achieve the desired objects and advantages of the instant invention provided is a compound leverage hand tool including a first section having a first handle end and an opposing first jaw portion with a first jaw end, a second section having a second handle end and a link end, and a second jaw portion having a second jaw end and a lever end, the second jaw portion pivotally coupled to the first jaw portion at a first pivot point intermediate the second jaw end and the lever end. The link end of the second section is pivotally coupled to the lever end of the second jaw portion at a second pivot point. The link end of the second section is pivotally coupled to the first section proximate the first jaw portion at a sliding pivot point intermediate the first pivot point and the second pivot point. The first jaw portion and the second jaw portion are pivoted about the first pivot point between an open position in which the first jaw end and the second jaw end are spaced apart and a closed position in which the first jaw end and the second jaw end are adjacent one another.

In a further aspect, provided is a compound leverage hand tool wherein the link end of the second section is bifurcated with two aligned furcation spaced apart to receive the first section and the lever end of the second jaw portion therebetween. The sliding pivot point includes a slot formed in each of the aligned furcations of the link end of the second section and a pin extends through the first section proximate the first jaw portion and is rotatably and slidably received within each slot of the aligned furcations. A distance separating the sliding pivot point from the second pivot point is reduced as the first jaw portion and the second jaw portion are moved from the open position to the closed position.

In yet another aspect, provided is a compound leverage hand tool including a first section having a first handle end and an opposing first jaw portion with a first jaw end. The first section is rigid along its entire length. A second section has a second handle end and a link end. A second jaw portion has a second jaw end and an opposing end. The second jaw portion is pivotally coupled to the first jaw portion at a first pivot point intermediate the second jaw end and the opposing end and is pivotally coupled to the second section intermediate the second handle end and the first link end at a second pivot point. A first link has an end pivotally coupled to the first link end of the second section at a third pivot point and an opposing end pivotally coupled to the first section intermediate the first handle end and an opposing first jaw portion at a fourth pivot point. The first jaw portion and the second jaw portion are pivoted about the first pivot point between an open position in which the first jaw end and the second jaw end are spaced apart and a closed position in which the first jaw end and the second jaw end are adjacent one another.

In yet a further aspect, the second section is separated and pivotally coupled at a fifth pivot point intermediate the second handle end and the first link end. A second link end extends from the second section at the fifth pivot point. A second link having an end, is pivotally coupled to the second link end of the second section at a sixth pivot point and an opposing end is pivotally coupled to the first section intermediate the first handle end and the fourth pivot point.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 13:
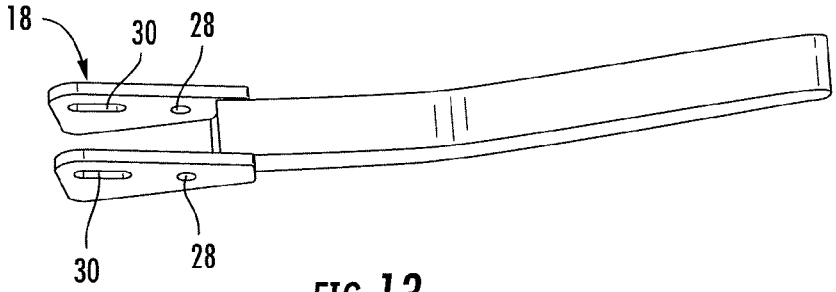
FIG. 13 is a perspective view of a section of the compound pliers of FIG. 11.

Turning now to the drawings in which like reference characters indicate corresponding elements throughout the several views, attention is directed to FIGS. 1-4 and 11-13 which illustrate a compound leverage hand tool, which in this specific embodiment is a pair of pliers 10. Pliers 10 include a compound leverage mechanism to increase their gripping or cutting power. While a pair of pliers is shown in the present embodiment, it will be understood that other types of hand tools are also included in the present invention. As an example, the same mechanism can be employed with tin snips, wire cutters, side cutters, and the like. Pliers 10 include a section 12 having a handle end 13 and a jaw end 11 of an opposing jaw portion 14 integrally formed therewith. A section 15 includes a handle end 17 and a link end 18 (FIG. 13). A jaw portion 20 includes a jaw end 22 and a lever end 23. Jaw portion 20 is pivotally coupled to jaw portion 14 at apertures 25 and 26, respectively, by a pin, rivet, or the like, journaled therethrough to form a pivot point 34. Link end 18 is a bifurcated end with two aligned furcation spaced apart to receive section 12 and lever end 23 therebetween. Link end 18 is pivotally coupled to lever end 23 at apertures 28 and 29, respectively, by a pin, rivet, or the like, journaled therethrough to form a pivot point 35. It will be understood that a pin or the like is journaled through aligned apertures 28 in both furcations, with lever end 23 positioning aperture 29 therebetween. A slot 30 is formed in link end 18 through both furcations. Link end 18 is pivotally coupled to section 12 proximate jaw portion 14 at slot 30 and an aperture 32, by a pin, rivet, or the like, journaled therethrough to form a sliding pivot point 36. It will be understood that a pin or the like is journaled through aligned slots 30 in both furcations, with section 12 positioning aperture 32 therebetween. Slot 30 permits movement of the jaws between an open position and a closed position. Jaw portions 14 and 20 are pivoted about pivot point 34 between an open position in which jaw end 11 and jaw end 22 are spaced apart and a closed position in which jaw end 11 and jaw end 22 contact one another for gripping in the case of pliers or cutting in the case of wire cutters and the like.

Figure 1:
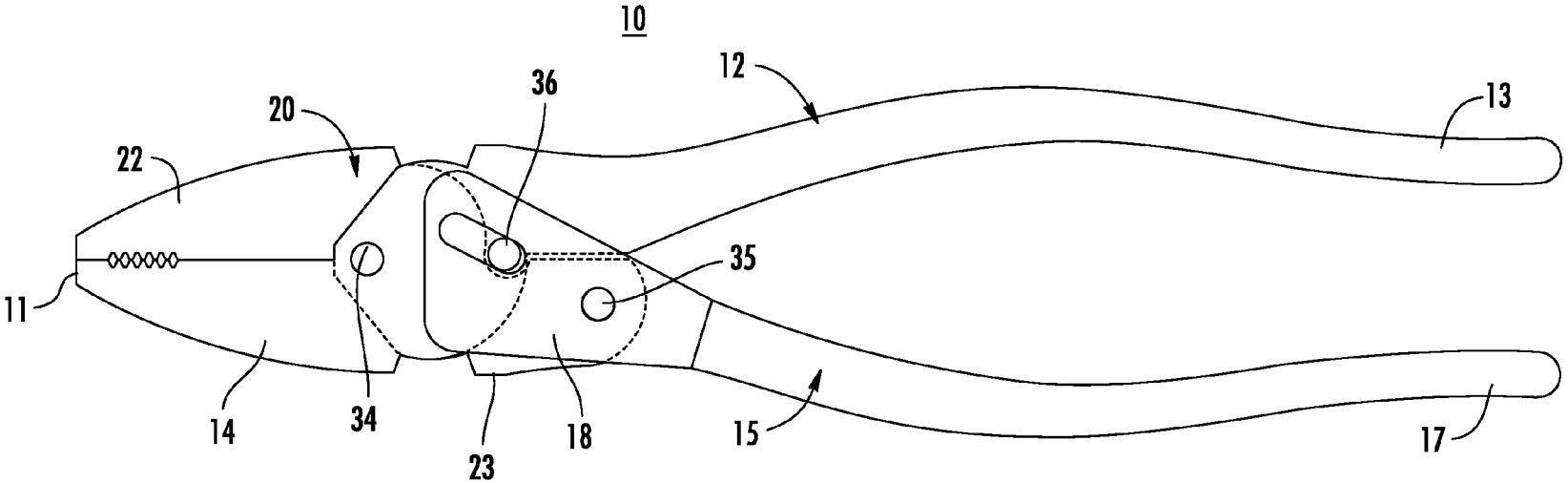
FIG. 1 is a side view of compound pliers in a closed position, according to the present invention.
Figure 2:
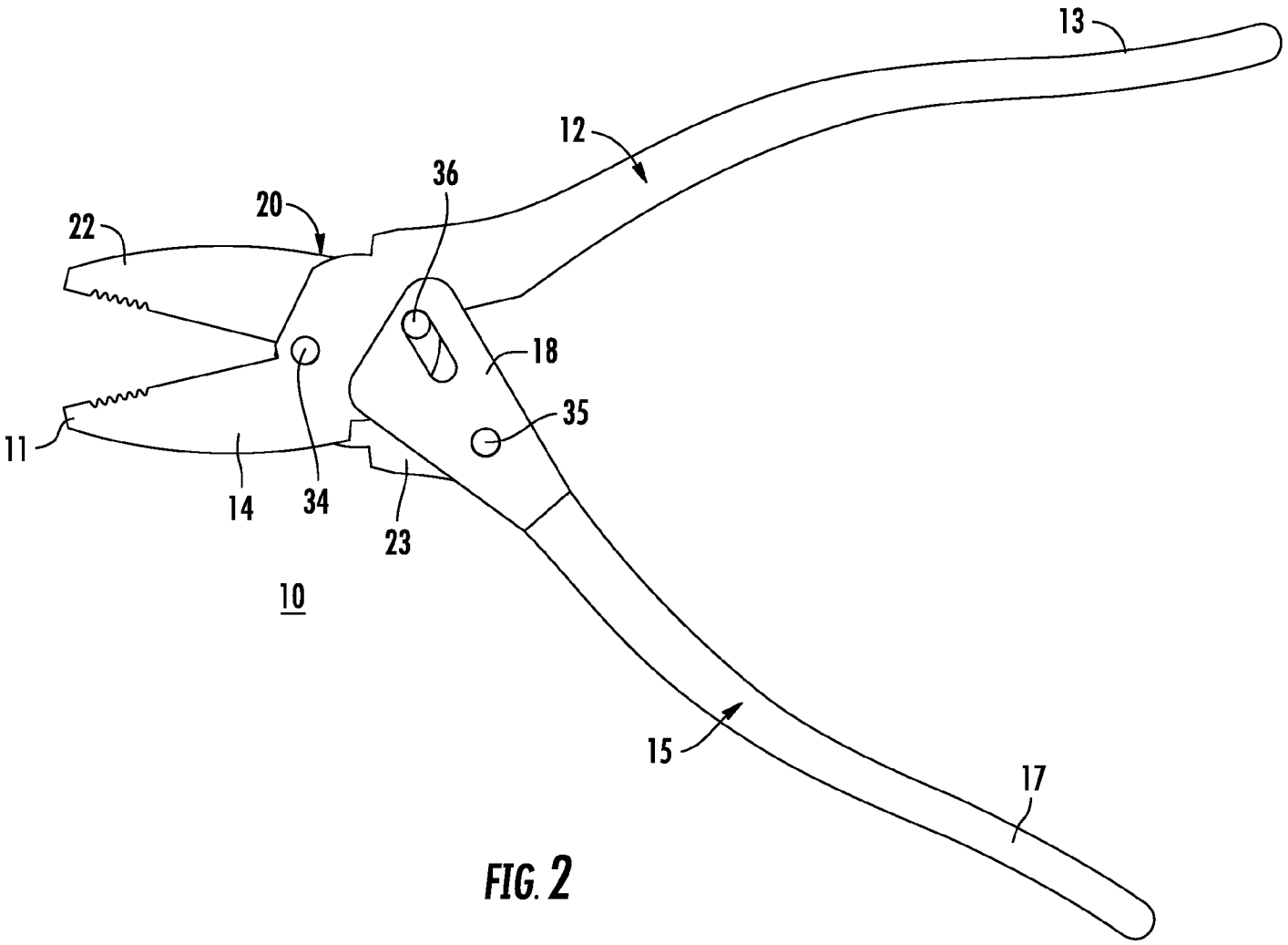
FIG. 2 is a side view of the compound pliers of FIG. 1, in an open position.
Figure 3:
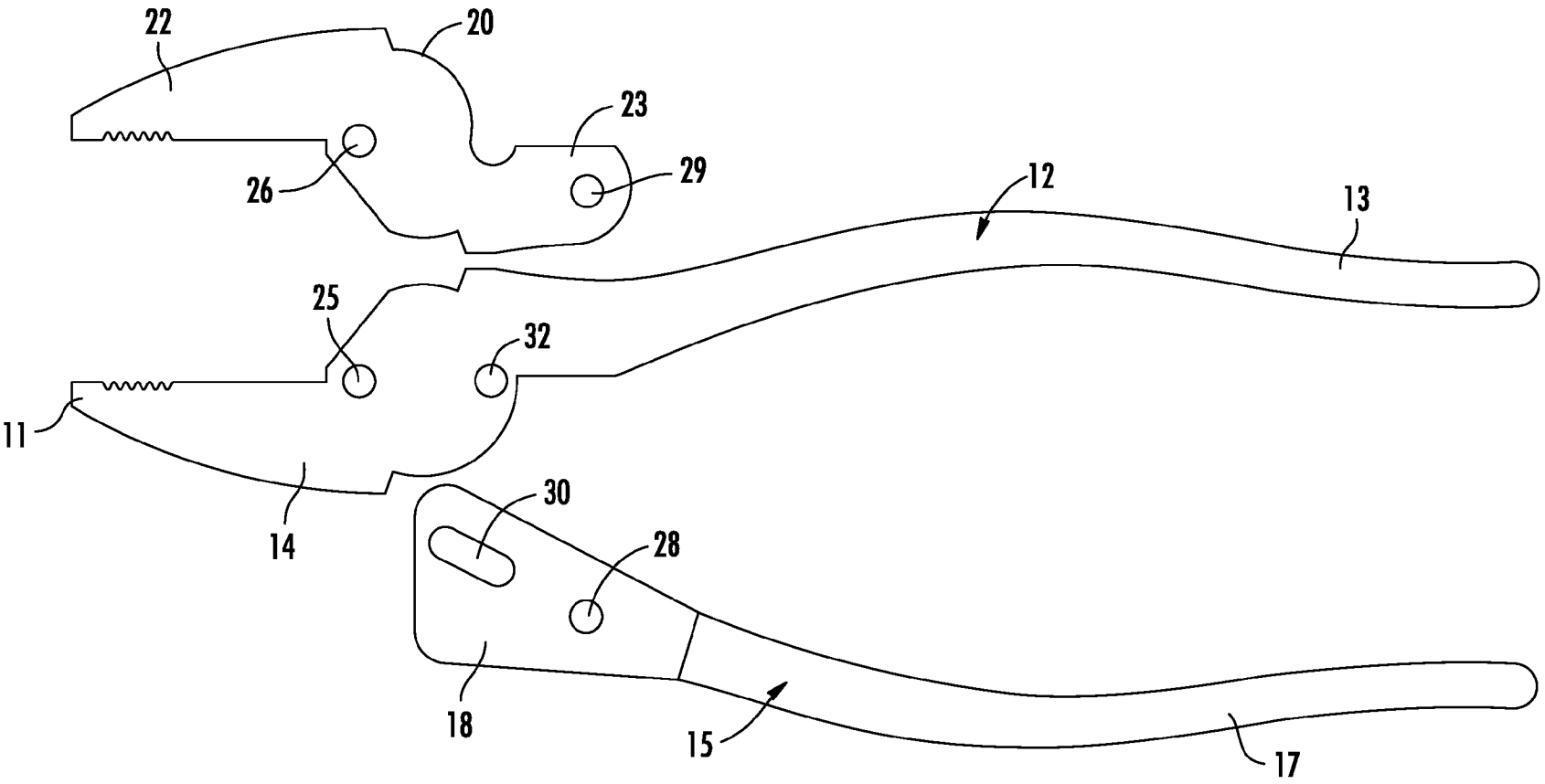
FIG. 3 is an exploded view of the compound pliers of FIGS. 1 and 2.
Figure 4A:
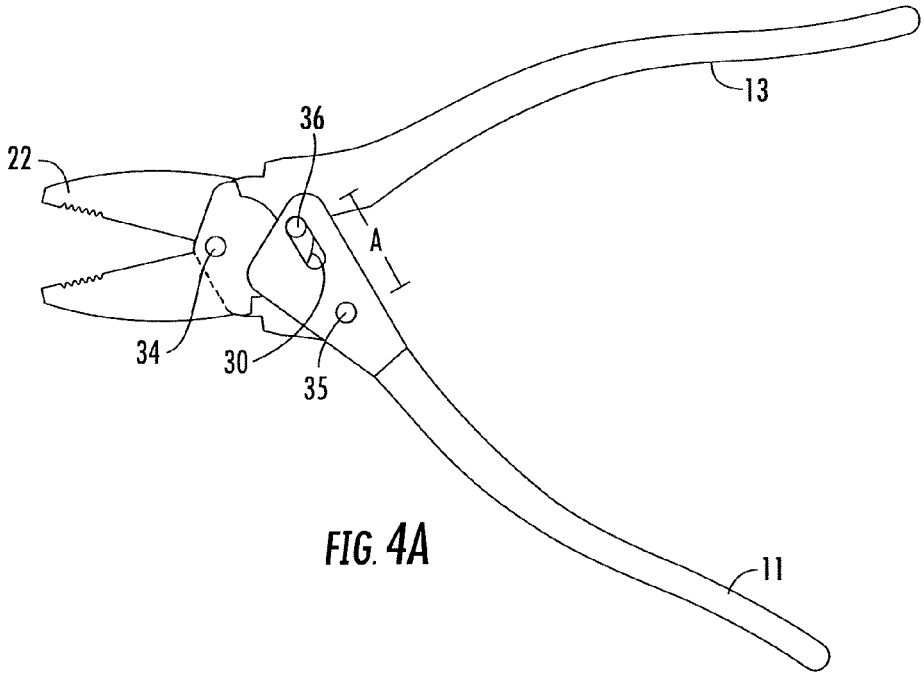
FIGS. 4*a-c* are side views of the compound pliers of FIGS. 1, 2, and 3, from the open position to the closed position.
Figure 4B:
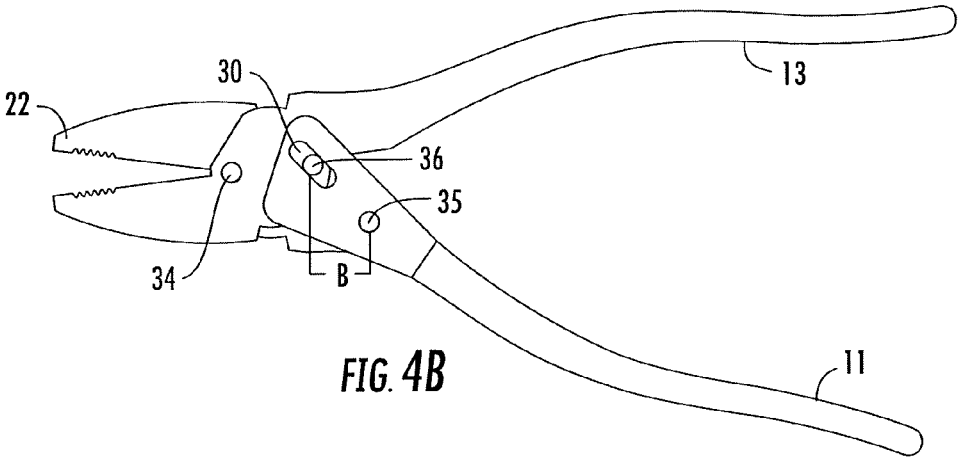
Figure 4C:
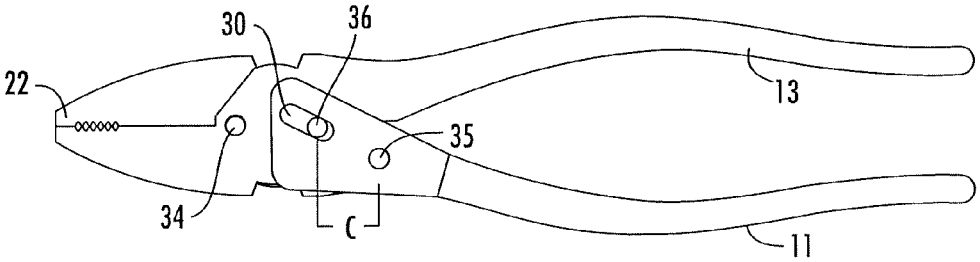

Referring specifically to FIGS. 4*a*-4*c*, it can be seen that slot 30 and aperture 32 forming sliding pivot point 36 are aligned and positioned rearwardly (toward handle ends 13 and 17) from apertures 25 and 26 forming pivot point 34, and forwardly (toward jaw ends 11 and 22) of apertures 28 and 29 forming pivot point 35. In the configuration of links as shown in pliers 10, the closer together sliding pivot point 36 and pivot point 35 are the greater the power generated. Sliding pivot point 36 and pivot point 35 are separated by a distance designated A in the fully open position (FIG. 4*a*). As pliers 10 is moved to a closed position (FIG. 4*c*) through an intermediate position (FIG. 4*b*), the distance separating sliding pivot point 36 and pivot point 35 is reduced from a distance designated B in the intermediate position to a distance designated C in the closed position. The distance between sliding pivot point 36 and pivot point 35 at any given time depends on the position aperture 32 is in with reference to slot 30. The length of slot 30 will determine the range of distances between sliding pivot point 36 and pivot point 35. Thus it can be seen that the greatest power generation is toward the closed position where the power is typically needed in cutting operations and the like. In conventional hand tools, the tool has more power generated at the open jaw position and less as the jaws move to the closed position.

Figure 5:
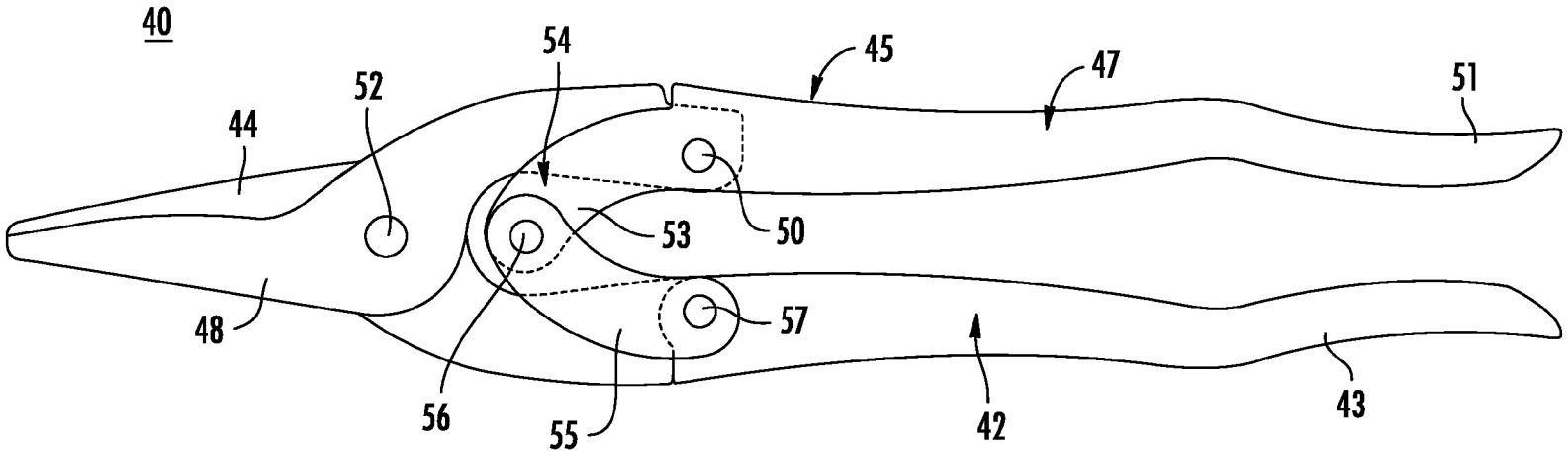
FIG. 5 is a side view of another embodiment of single compound pliers in a closed position, according to the present invention.
Figure 6:
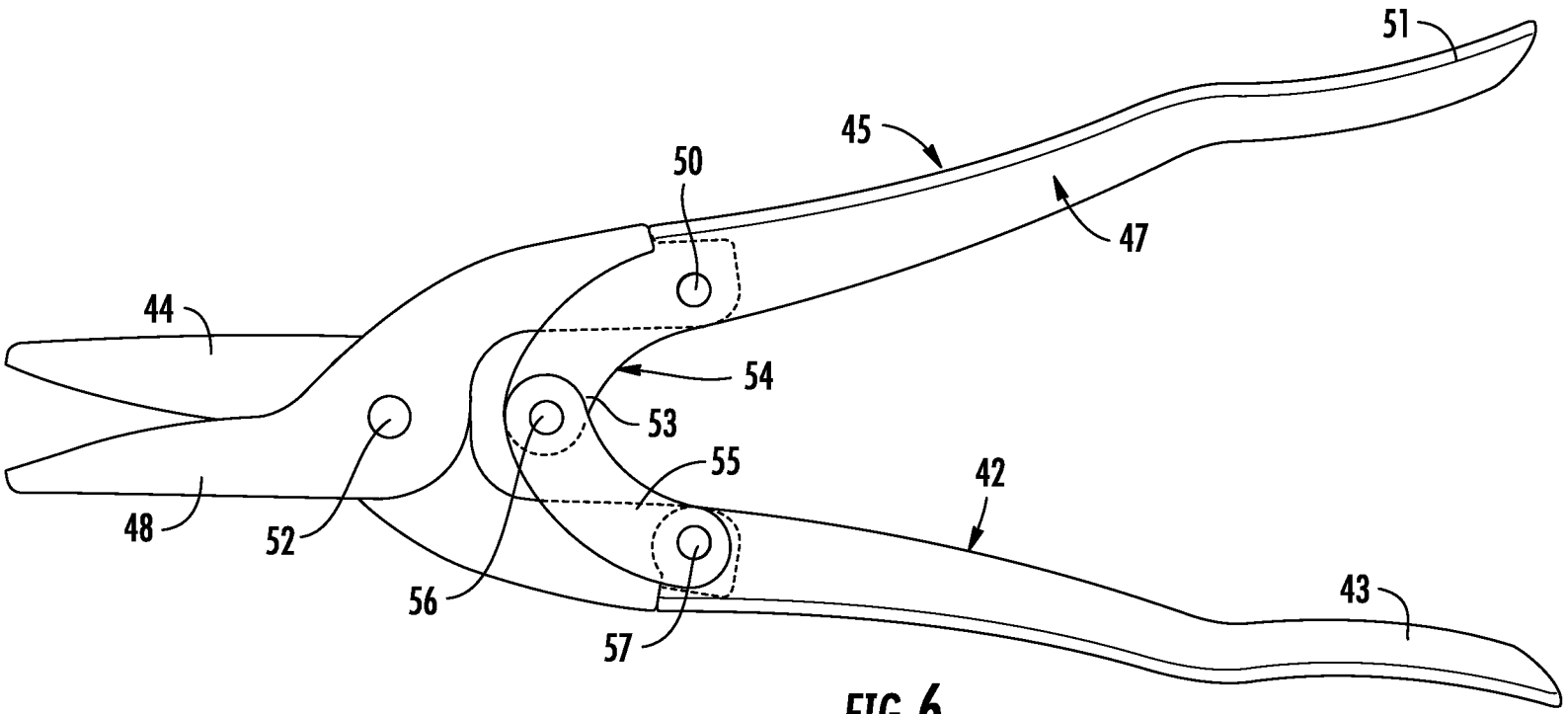
FIG. 6 is a side view of the single compound pliers of FIG. 5, in an open position.
Figure 7:
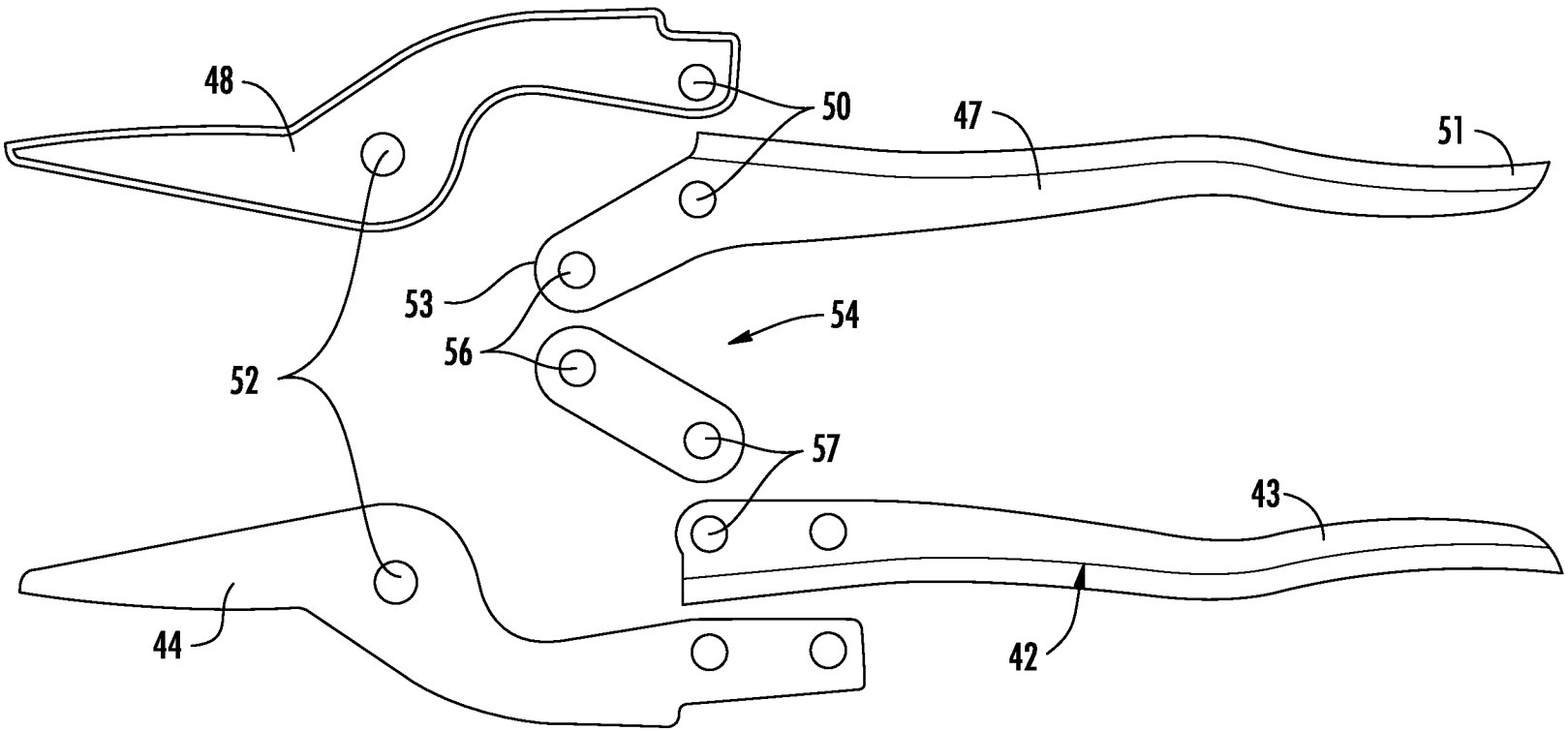
FIG. 7 is an exploded view of the single compound pliers of FIGS. 5 and 6.

FIGS. 5-7 illustrate a single compound leverage hand tool, which in this specific embodiment is a single compound leverage pliers 40. While a pair of pliers is shown in the present embodiment, it will be understood that other types of hand tools are also included in the present invention. As an example, the same mechanism can be employed with tin snips, wire cutters, side cutters, and the like. Pliers 40 include a section 42 having a handle end 43 and an opposing jaw portion 44 integrally formed therewith. Section 42 can be formed as a single element, as seen in FIGS. 5 and 6, or as multiple elements coupled such as by rivets, screw, welding and the like, to form an integral piece, as seen in FIG. 7. A section 45 has a handle portion 47 and a jaw portion 48 pivotally coupled at a pivot point 50. Handle portion 47 includes a handle end 51 and an opposing link end 53. Pivot point 50 is positioned intermediate handle end 51 and link end 53. Section 42 and 45 are pivotally coupled at a pivot point 52 with link end 53 of handle portion 47 extending therebetween. A linkage mechanism 54 is coupled between section 42 and section 45 to provide leverage when pliers 40 is moved from an open position (FIG. 6) to a closed position (FIG. 5). Linkage mechanism 54 includes a link 55 pivotally coupled at one end to link end 53 forming a pivot point 56 and at an opposing end to section 42 intermediate jaw portion 44 and handle end 43 forming a pivot point 57. It will be understood that the various pivot points can be formed by a pin, rivet, or the like, journaled through apertures aligned in the various described elements. As this is well known technique, further description is not required. It should also be specifically pointed out, that section 42 is rigid along its entire length. This is to reduce the distance between handle end 43 and handle end 51 with the pliers in the open position. The rigid handle of one side, compared to the other side, allows for easier gripping and use of pliers 40.

Figure 8:
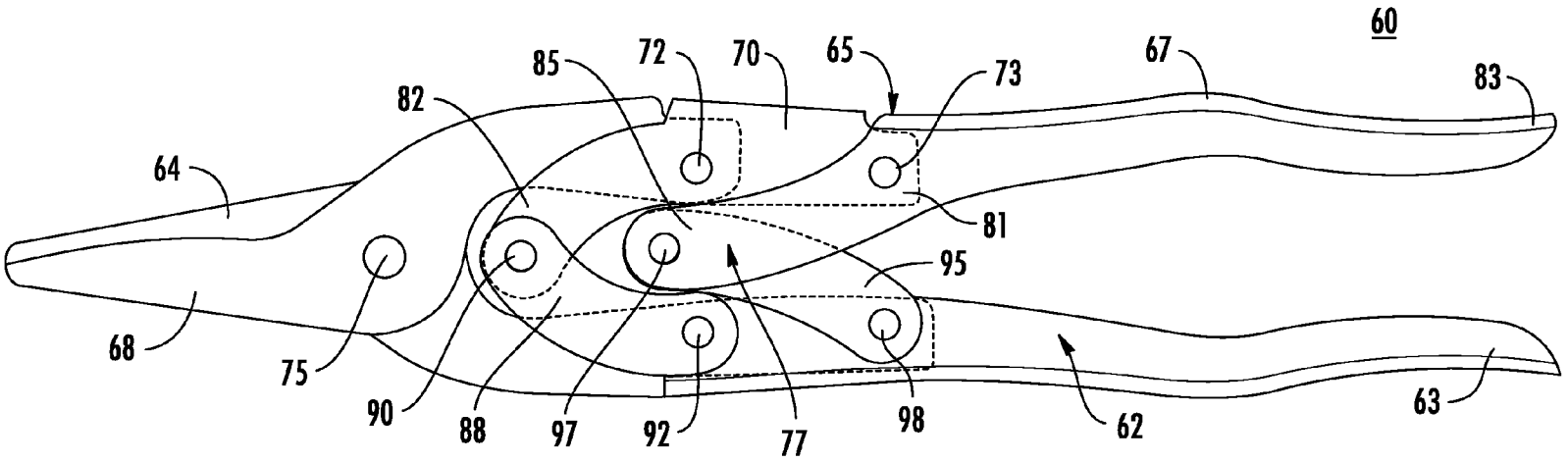
FIG. 8 is a side view of another embodiment of double compound pliers in a closed position, according to the present invention.
Figure 9:
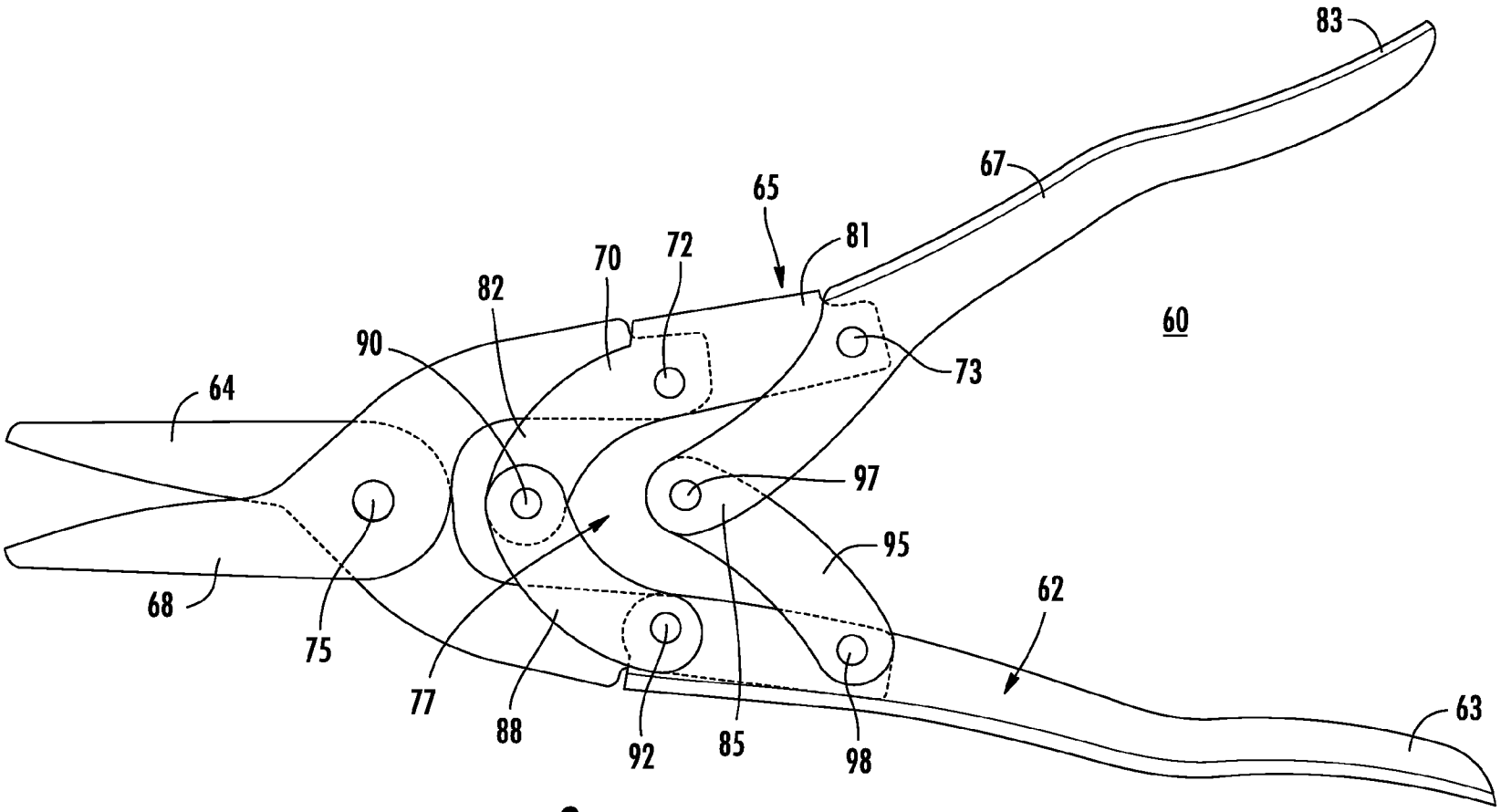
FIG. 9 is a side view of the double compound pliers of FIG. 8, in an open position.
Figure 10:
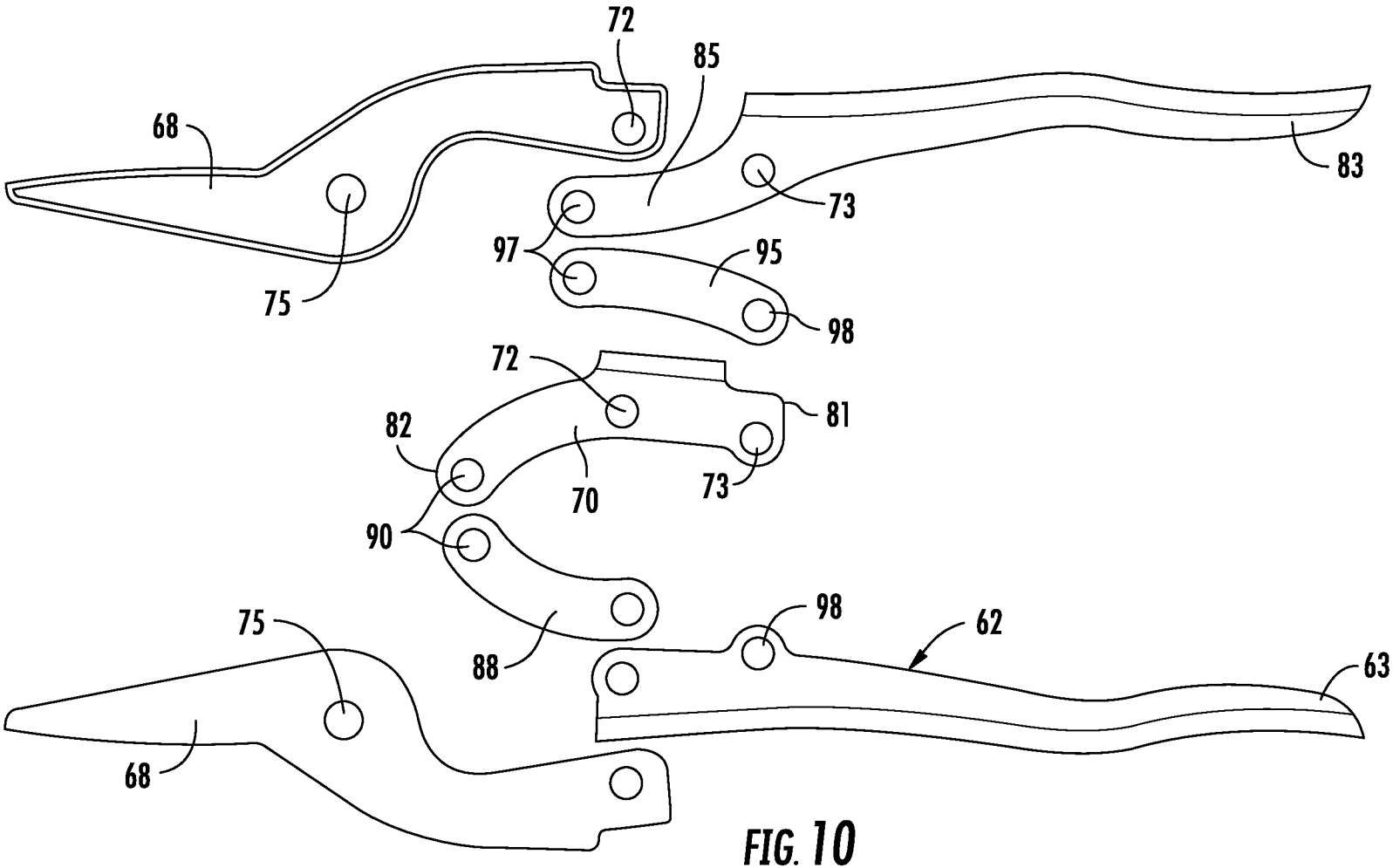
FIG. 10 is an exploded view of the double compound pliers of FIGS. 8 and 9.
Figure 11:
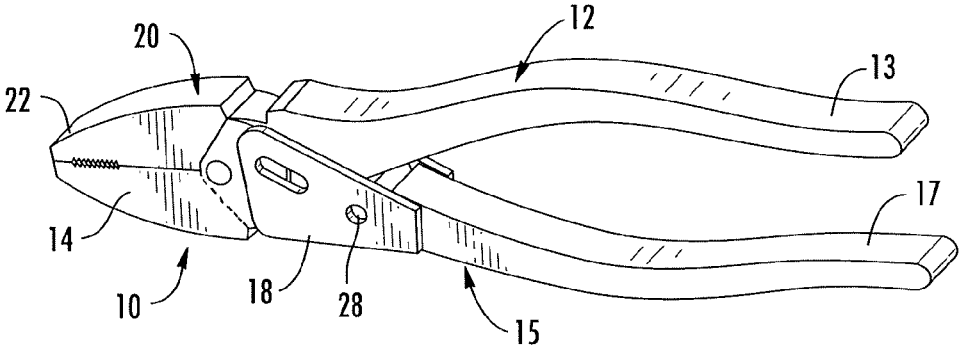
FIG. 11 is a side perspective view of the compound pliers illustrated in FIGS. 1-4.
Figure 12:
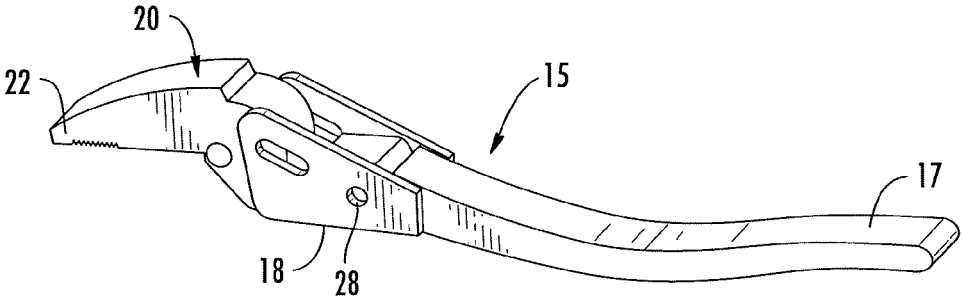
FIG. 12 is a perspective view of a portion of the compound pliers of FIG. 11.

FIGS. 8-10 illustrate double compound leverage pliers 60. While a pair of pliers is shown in the present embodiment, it will be understood that other types of hand tools are also included in the present invention. As an example, the same mechanism can be employed with tin snips, wire cutters, side cutters, and the like. Pliers 60 include a section 62 having a handle end 63 and an opposing jaw portion 64 integrally formed therewith. Section 62 can be formed as a single element, or as multiple elements coupled to form an integral piece. A section 65 has a handle portion 67 and a jaw portion 68 coupled by an intermediate portion 70. Jaw portion 68 is pivotally coupled to intermediate portion 70 intermediate opposing ends 81 and 82 at a pivot point 72. Handle portion 67 includes a handle end 83 and an opposing link end 85. End 81 of intermediate portion 70 is pivotally coupled to handle portion 67 intermediate handle end 83 and link end 85. Section 62 and 65 are pivotally coupled at a pivot point 75 adjacent jaw portion 64 and jaw portion 68. A double linkage mechanism 77 is coupled between section 62 and section 65 to provide leverage when pliers 60 is moved from an open position (FIG. 9) to a closed position (FIG. 8). Linkage mechanism 77 includes a link 88 pivotally coupled at one end to end 82 of intermediate portion 70 forming a pivot point 90 and at an opposing end to section 62 intermediate jaw portion 64 and handle end 63 forming a pivot point 92. Link mechanism 77 further includes a link 95 pivotally coupled at one end to link end 85 of handle portion 67 forming a pivot point 97 and at an opposing end to section 62 intermediate pivot point 92 and handle end 63 forming a pivot point 98. It will be understood that the various pivot points can be formed by a pin, rivet, or the like, journaled through apertures aligned in the various described elements. As this is well known technique, further description is not required. It should also be specifically pointed out, that section 62 is rigid along its entire length to reduce the distance between handle end 63 and handle end 83 with the pliers in the open position. The rigid handle of one side, compared to the other side, allows for easier gripping and use of pliers 60.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A compound leverage hand tool comprising:

a first section having a first handle end and an opposing first jaw portion with a first jaw end;

a second section having a second handle end and a link end, the second section defining a longitudinal axis;

a second jaw portion having a second jaw end and a lever end, the second jaw portion pivotally coupled to the first jaw portion at a first pivot point intermediate the second jaw end and the lever end;

the link end of the second section is bifurcated with two aligned furcations spaced apart to receive the first section and the lever end of the second jaw portion therebetween;

the link end of the second section being pivotally coupled to the lever end of the second jaw portion at a second pivot point;

the link end of the second section being pivotally coupled to the first section proximate the first jaw portion at a sliding pivot point intermediate the first pivot point and the second pivot point, the sliding pivot point includes a slot formed in each of the two aligned furcations of the link end of the second section and a pin extending from the first section proximate the first jaw portion rotatably and slidably received within the slot formed in each of the two aligned furcations; and the first section and the lever end of the second jaw portion are received between the furcations of the link end of the second section along an axis substantially perpendicular to the longitudinal axis of the second portion;

wherein the first jaw portion and the second jaw portion are pivoted about the first pivot point between an open position in which the first jaw end and the second jaw end are spaced apart and a closed position in which the first jaw end and the second jaw end are adjacent one another.

2. A compound leverage hand tool as claimed in claim 1 wherein a distance separating the sliding pivot point from the second pivot point is reduced as the first jaw portion and the second jaw portion are moved from the open position to the closed position.

3. A compound leverage hand tool comprising:

a first section having a first handle end and an opposing first jaw portion with a first jaw end;

a second section having a second handle end and a link end being bifurcated with two aligned spaced apart furcations, the second section defining a longitudinal axis;

a second jaw portion having a second jaw end and a lever end, the second jaw portion pivotally coupled to the first jaw portion at a first pivot point intermediate the second jaw end and the lever end;

the lever end of the second jaw portion received between the furcations of the link end of the second section and pivotally coupled between the furcations at a second pivot point;

the first section proximate the first jaw portion received between the furcations of the link end of the second section and pivotally and slidably coupled between the furcation at a sliding pivot point intermediate the first pivot point and the second pivot point; and the first section and the lever end of the second jaw portion are received between the furcations of the link end of the second section along an axis substantially perpendicular to the longitudinal axis of the second portion;

wherein the first jaw portion and the second jaw portion are pivoted about the first pivot point between an open position in which the first jaw end and the second jaw end are spaced apart and a closed position in which the first jaw end and the second jaw end are adjacent one another.

4. A compound leverage hand tool as claimed in claim 3 wherein the sliding pivot point includes a slot formed in each of the aligned furcations of the link end of the second section and a pin extending through the first section proximate the first jaw portion and rotatably and slidably received within each slot of the aligned furcations.

5. A compound leverage hand tool as claimed in claim 4 wherein a distance separating the sliding pivot point from the second pivot point is reduced as the first jaw portion and the second jaw portion are moved from the open position to the closed position.

* * * * *